United States Patent [19]

Meyers

[11] 3,995,344

[45] Dec. 7, 1976

[54] LOW PROFILE SOAKING PIT MACHINE

[75] Inventor: Leo J. Meyers, Pittsburgh, Pa.

[73] Assignee: Louis A. Grant, Inc., Pittsburgh, Pa.

[22] Filed: Nov. 14, 1975

[21] Appl. No.: 632,167

[52] U.S. Cl. ..... 15/104.07; 173/43

[51] Int. Cl.[2] ..... B08B 1/00; E21C 9/00

[58] Field of Search ..... 15/104.07; 173/28, 34, 173/35, 43

[56] References Cited

UNITED STATES PATENTS

| | | | |
|---|---|---|---|
| 3,346,300 | 10/1967 | Grant | 173/43 X |
| 3,356,163 | 12/1967 | Rowe et al. | 173/43 |
| 3,370,654 | 2/1968 | Skendrovic | 173/43 |
| 3,458,396 | 7/1969 | Grant | 173/43 X |
| 3,471,888 | 10/1969 | Grant et al. | 15/104.07 |
| 3,576,218 | 4/1971 | Lisenby | 173/28 |

FOREIGN PATENTS OR APPLICATIONS

| | | | |
|---|---|---|---|
| 514,261 | 2/1955 | Italy | 15/104.07 |

OTHER PUBLICATIONS

Ingersoll-Rand, "HMB Hydra-Boom Mounted Breaker", Ingersoll-Rand Company 1964.

*Primary Examiner*—Charles E. Phillips
*Attorney, Agent, or Firm*—Buell, Blenko & Ziesenheim

[57] ABSTRACT

A low profile soaking pit machine for breaking and removing slag from a soaking pit. The machine has a low horizontal profile above the soaking pit to permit a soaking pit cover carriage to pass over the machine when the machine is resting on the soaking pit. The machine has a supporting frame and a means for rotatably and pivotally supporting a demolition tool downwardly from the horizontal frame. The tool breaks the slag. A second means couples the first means to the horizontal frame and raises and lowers the first means above the horizontal frame from a collapsed position which provides the low horizontal profile.

4 Claims, 7 Drawing Figures

LOW PROFILE SOAKING PIT MACHINE

This invention relates to a low profile soaking pit machine which is capable of permitting a soaking pit cover carriage to pass over the machine.

PROBLEM PRESENTED TO THE INVENTOR

In some steel mills there are soaking pits which have covers that are removed by a special soaking pit cover carriage which rolls on rails over a group or row of soaking pits which are adjacent to each other. The cover carriage is also referred to as a cover crane (e.g., THE MAKING, SHAPING AND TREATING OF STEEL, by United States Steel, 1957, PP. 402 and 404). The carriage has a clearance of approximately 30 inches between the top of the pit and the under surface of the pit cover carriage. The carriage is capable of selectively latching onto one of the soaking pit covers lifting it a few inches to break the sand seal and then carries it back as the carriage is moved back along a trackway away from the soaking pit. The cover is replaced in a reverse manner.

These soaking pits sometimes have a shallow dimension between the top of the slag debris buildup to the bottom of the cover over the pit (or the top of the pit). Existing soaking pit cleaning machines are not designed to accommodate the shallow clearance between the top of the pit and the debris while at the same time permit a soaking pit cover carriage to pass freely over the machine while it is resting on the pit.

Frequently while one pit is being cleaned with a soaking pit cleaning machine resting on it, the adjacent pits are in operation and the soaking pit cover carriage which removes the covers by carrying them back away from the pit opening must pass over the soaking pit machine to remove one or more of the covers of the adjacent pits for the purpose of either removing an ingot and/or charging it with a new ingot. A serious problem is presented to a soaking pit cleaning machine design which must meet two constraints. One — accommodating a pit which has large accumulation of slag and, therefore, presents a shallow pit initially which must be cleaned to a depth of an ordinary full depth pit; and two — at the same time the machine must present a low horizontal profile above the top of the pit to enable the pit cover carriage which has a clearance of only 30 inches to pass over the soaking pit machine. This avoids the necessity of removing the soaking pit machine every time one of the adjacent pits had to be charged with an ingot or have one removed from it.

PRIOR ART

Skendrovic U.S. Pat. No. 3,370,654: This patent shows a soaking pit cleaning machine which does not show any structure above the horizontal frame. However, while it may present a low profile in order to permit a soaking pit cover carriage to pass over it, the constraint between the top of the pit and the top of the slag 22 must be of such a sufficient dimension as to permit the boom assembly which carries the demolition tool to accommodate the demolition tool housing assembly to permit the tool to remove the slag. If the dimension is too small the boom assembly with the tool cradle could not work the pit. If the slag 22 is substantially closer to the top of the pit it would be impossible to collapse and cram the Skendrovic structure depending from the horizontal support resting on the top of the pit within the space between the top of the pit and the slag. The Skendrovic sturcture, therefore, is capable of being used only when the available space between the top of the slag and the top of the pit permits insertion of the assembly within that dimension.

Grant U.S. Pat. No. 3,458,396: This patent shows a machine for cleaning soaking pits which also appears to show a relatively low profile above the pit, however, it is limited in the same manner in which the Skendrovic patent sturcture is limited, namely the distance between the top of the pit and the top of the slag must be sufficient to accommodate the boom structure.

Grant U.S. Pat. No. 3,471,888: This patent shows a machine for cleaning a soaking pit and it suffers from the same problem as the Skendrovic patent and the Grant U.S. Pat. No. 3,458,396, namely, the dimension between the top of the slag and the top of the soaking pit must be sufficient to accommodate the boom assembly structures. Furthermore, this patent does not show what would appear to be a low profile above the pit which should be less than 30 inches to enable the pit cover carriage to pass freely over it.

The Ingersoll-Rand HMB Hydra-Boom Mounted Breaker: This is a 1964 publication by Ingersoll-Rand Company and shows a soaking pit cleaning machine which does not provide a low horizontal profile above the pit to permit a pit cover carriage to pass freely over it; and the boom assembly is such that it is not capable of accommodating a shallow dimension between the top of the slag and top of the soaking pit.

None of the above art was directed to the problem to which the inventor has addressed his machine design.

THE INVENTOR'S SOLUTION TO THE PROBLEM

I have designed a soaking pit machine which is capable of working in a very shallow depth between the top of the slag and the top of the pit and removing the debris to the full depth of the pit while at the same time providing a low horizontal profile above the pit to enable the soaking pit cover carriage which is used for removing and replacing the soaking pit covers to pass freely over the soaking pit machine while it is resting on the pit.

I provide a machine for breaking and removing slag from a soaking pit and presenting a low horizontal profile above the pit to permit a soaking pit cover carriage to pass freely over the machine while resting on the soaking pit comprising a horizontal supporting frame for resting on top of the soaking pit; a first means supporting a demolition tool downwardly from the horizontal frame for breaking the slag in the pit; and a second means coupling the first means to the horizontal supporting frame and raising the first means upwardly above the horizontal frame from a collapsed position which provides a low horizontal profile to permit the soaking pit cover carriage to pass freely over the soaking pit while the machine is resting on the soaking pit, the second means being capable of lowering the first means from the raised position back to the collapsed position, when the first means is raised above the frame the demolition tool and boom assembly have enough clearance to work and break the slag in the pit.

I further provide that the first means in the machine has a turntable and a boom assembly pivotally mounted on the bottom surface of the turntable and extending downwardly from the turntable to which the demolition tool is pivotally mounted.

I further provide that the second means comprises a first boom member having one end pivotally connected to the horizontal supporting frame and at another point along the boom having the turntable pivotally connected. A second boom member having one end pivotally connected to the supporting frame and at another point along the boom having the turntable pivotally connected.

I also provide that the structure recited above with the four pivot points forms a parallelogram with the turntable always parallel to the support frame.

A DESCRIPTION OF THE STRUCTURE OF THE SOAKING PIT MACHINE

A. Horizontal Support Frame

Figure 2:
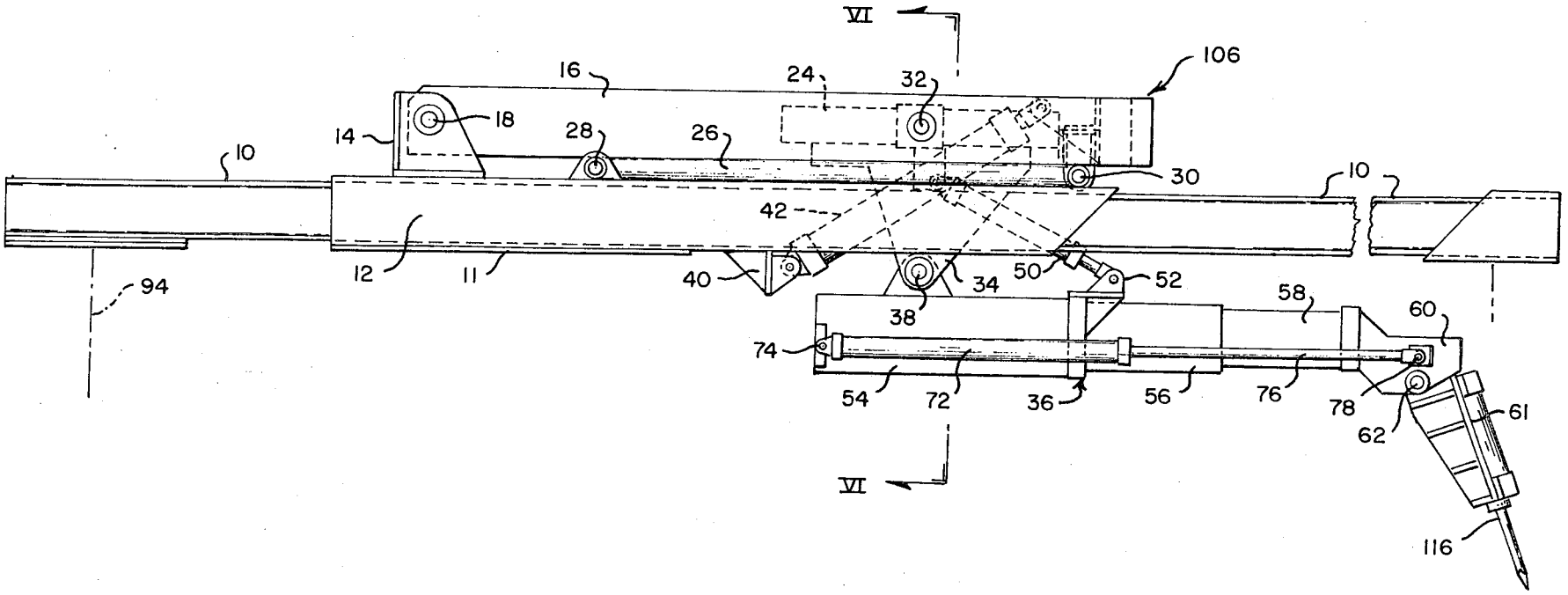
FIG. 2 is a side elevational view of the low profile soaking pit machine in its collapsed position.
Figure 3:
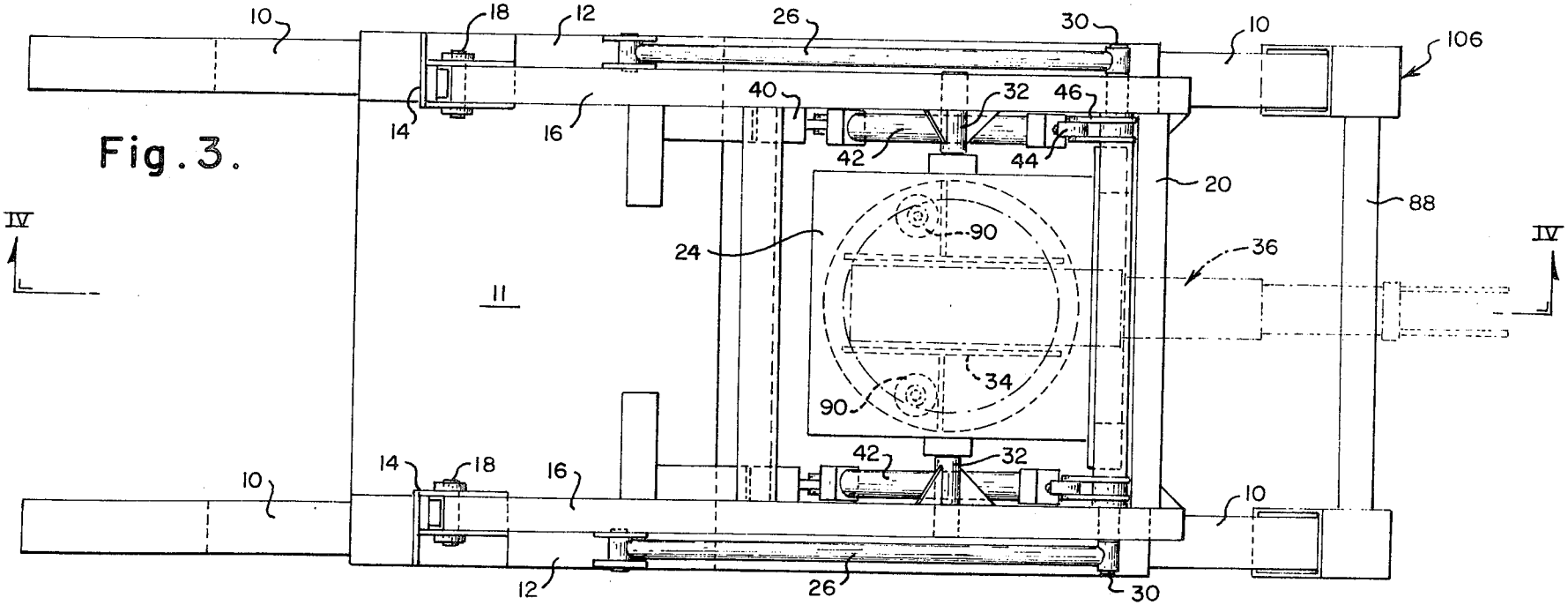
FIG. 3 is a top plan view of the machine.
Figure 5:
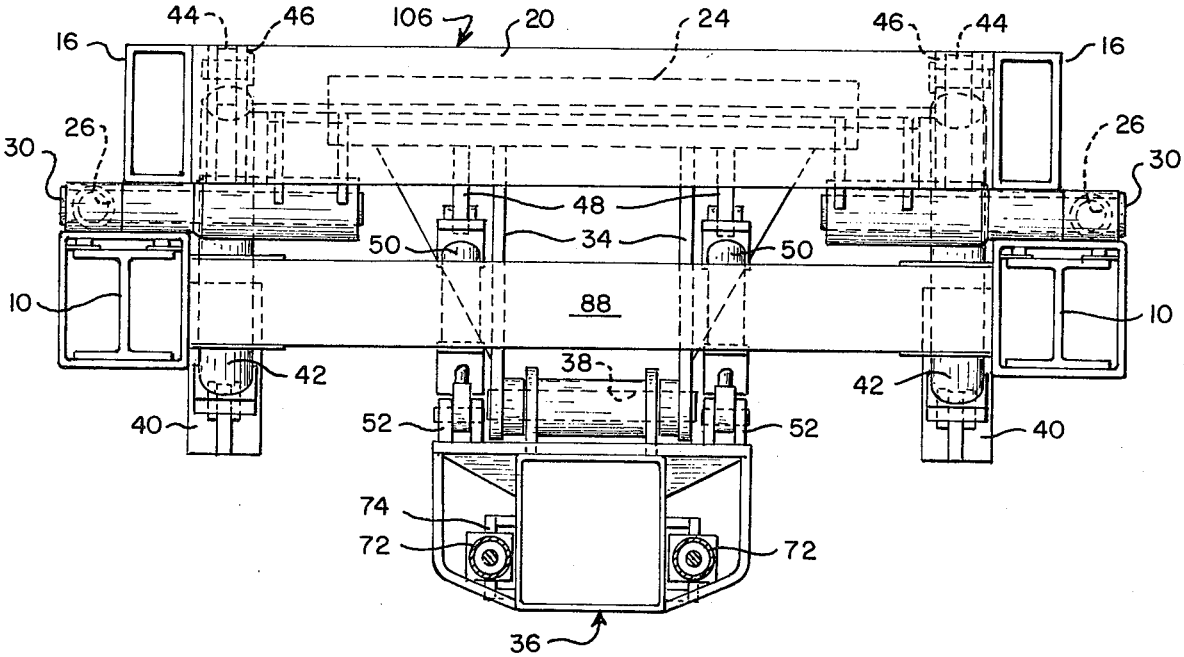
FIG. 5 is a front elevational view taken from the right of FIG. 2.
Figure 6:
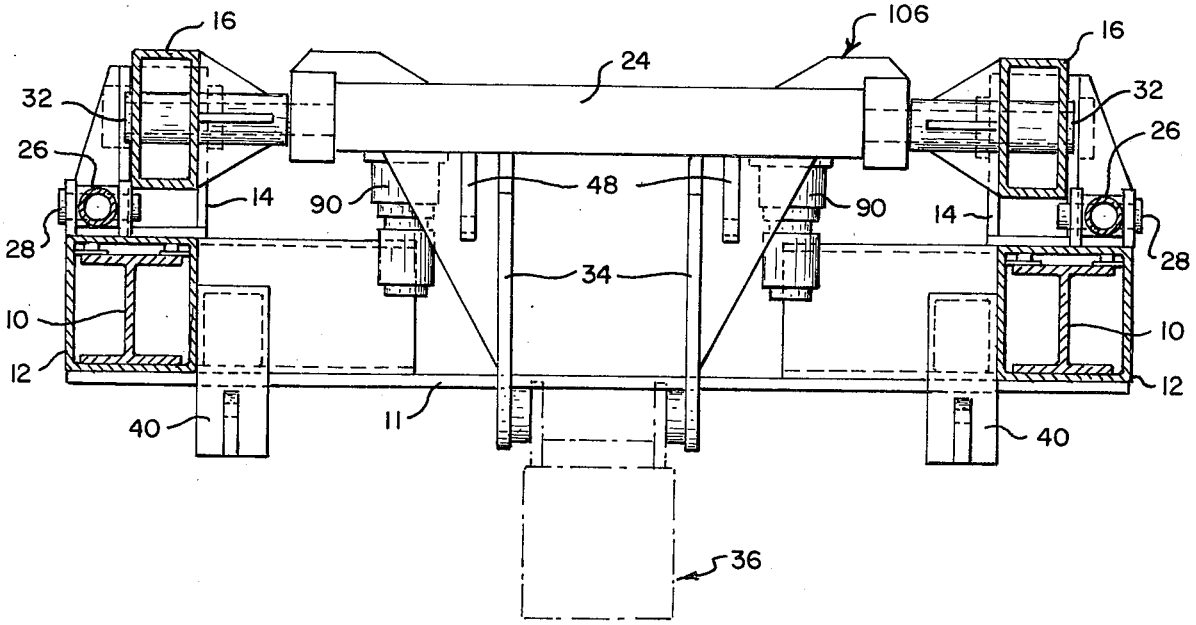
FIG. 6 is a transverse sectional view taken on the line VI—VI of FIG. 2.

Referring to FIGS. 2 and 3, there are shown two main support beams 10 which are of length to span a soaking pit along its major dimension. The two main support beams are attached to each other by a spanner member 88 located at the right end viewing FIGS. 3 and 4. Mounted on the beams 10 in slidable fashion are two frame members 12 which are spanned or connected on their under surfaces by a plate member 11. Plate 11 can be used to support the necessary power and control means for all hydraulic cylinders and hydraulic motors. A pedestal 14 is secured to the upper left surface of the frame members 12.

Means to slide the frame 12 relative to the main support beams 10 are provided by the use of two hydraulic cylinders 80 mounted between the webs of beams 10 and the inner walls of the slidable frame 12. The cylinders 80 are attached at their bases to the inner walls of the frame 12 at 82 and their piston rods 84 are attached to mounting brackets 86 mounted on the webs of the beams 10.

B. First Means Supporting a Demolition Tool

A rotating portion of a turntable 24 has depending from it two parallel plates 34 which support at their lower ends a telescopic boom 36 and are pivotally connected at their point of support by a pivot 38. Mounted beneath the turntable 24 and the outboard of the depending plates 34 are two brackets 48 which have attached thereto hydraulic cylinders 50. The piston rods of the cylinders 50 are attached to brackets 52 which are mounted on the forward end of an outer tube member 54 of the telescopic boom 36. The telescopic boom 36 has three telescopic tube members, the outer tube 54, an intermediate tube member 56 and an inner tube member 58. The inner tube member 58 has mounted at its exposed end a tool cradle support 60. Pivotally mounted to the support 60 at 62 is a tool cradle 61 carrying demolition tool 116. A link 64 is pivotally attached to the tool cradle 61 at 63 and the opposite end of the link 64 is pivotally attached to plates 66 which are slidable within the tube member 58. Hydraulic cylinder 68 anchored at 70 controls the tilt of the tool cradle carrying the demolition tool 116. Provisions are made to extend and retract the telescopic boom 36 by using a pair of hydraulic cylinders 72 (FIG. 2) which are anchored to the sides of the outer tube 54 at 74 and having the piston rod 76 pivotally connected at 78 to the tool cradle support 60.

C. Second Means Coupling The First Means To The Horizontal Support Frame

First boom members 16 (FIG. 2) are pivoted at 18 to the pedestals 14. The first boom members 16 are connected together by a spanner 20 at the opposite end from the pivot 18. A second spanner 22 is used intermediate the pivot end and spanner 20. Pivotally mounted between the first boom members 16 is the turntable 24 having trunnions 32 which support the turntable 24 between the booms 16 and also add to the rigidity of this framework. Pivotally mounted at 28 are a set of second boom members 26. The opposite ends of the second boom members 26 are pivoted to the turntable at 30.

Brackets 40 are mounted to the inner lower portions of the frame members 12 and have attached pivotally thereto a hydraulic cylinder 42 with a piston rod 44 that is pivotally connected to a mounting bracket 46 attached to the spanner 20 of the first boom members 16. It could also be suitably attached to the first boom 16 and it would be the equivalent.

THE OPERATION

Figure 1:
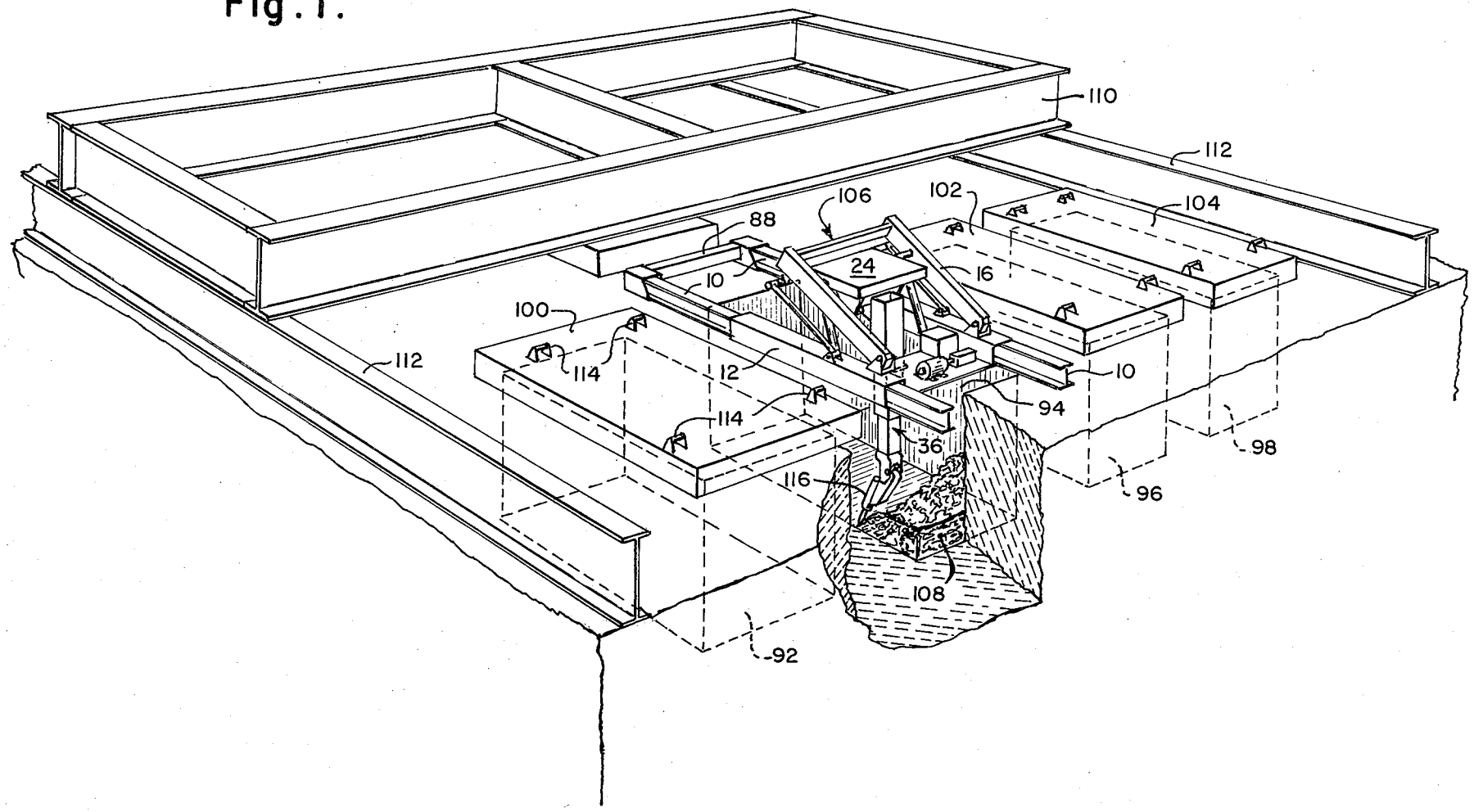
FIG. 1 is a diagrammatic view of the soaking pit machine placed over a pit showing the adjacent pits.

FIG. 1 shows a general view of a bank of four soaking pits 92, 94, 96 and 98. Soaking pits 92, 96 and 98 have covers 100, 102 and 104. Pit 94 has a soaking pit machine generally referred to as 106 which is resting on top of the pit and is in the process of cleaning slag 108 in pit 94. The boom assembly and turntable mechanism with the demolition tool shown in soaking pit machine 106 is raised above the horizontal frame support spanning pit 94. The turntable and boom assembly are raised above the horizontal support because the distance between the slag 108 and the top of the pit 94 is relatively shallow and less than the distance between the compressed telescopic boom assembly carrying the tool.

Figure 4:
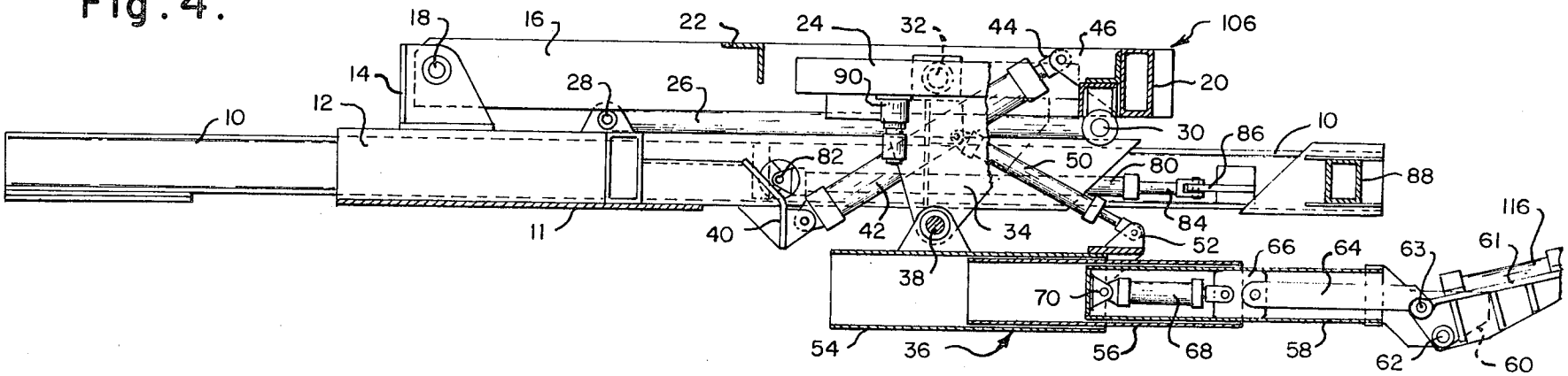
FIG. 4 is a longitudinal view partly in section taken on the line IV—IV of FIG. 3.

During the operation of the soaking pit machine 106 when one of the other remaining three pits 92, 96 or 98 requires recharging or removal of an ingot, the soaking pit machine 106 is collapsed (as shown in FIGS. 2 and 4) and the boom assembly is moved to a horizontal position to permit the soaking pit machine to collapse within the distance provided between the top of the slag 108 and the top of the pit 94. A soaking pit cover carriage 110 is then moved on rails 112 and one of the pit covers is lifted by suitable means by latching the four cover lugs 114 on cover 100 which is lifted a few inches and then the pit cover carriage 110 carries the pit cover 100 away from the soaking pit 92. An ingot (not shown) is then removed from pit 92 and a new ingot or ingots are placed in the pit. The pit cover 100 is then replaced by the cover carriage 110. Soaking pit machine 106 is then raised (as shown in FIG. 7) and the cleaning operation in pit 94 is continued until the slag is broken and removed from that pit.

Initially, soaking pit machine 106 is positioned over a soaking pit 94 (FIG. 1) by a mill crane or other suitable means and positioned to have the main support beams 10 resting on the curb or upper edges of the pit 94. Energization of cylinders 80 are used to position the slidable frame 12 to place the boom 36 and tool cradle 61 and demolition tool 116 in the area of work.

Figure 7:
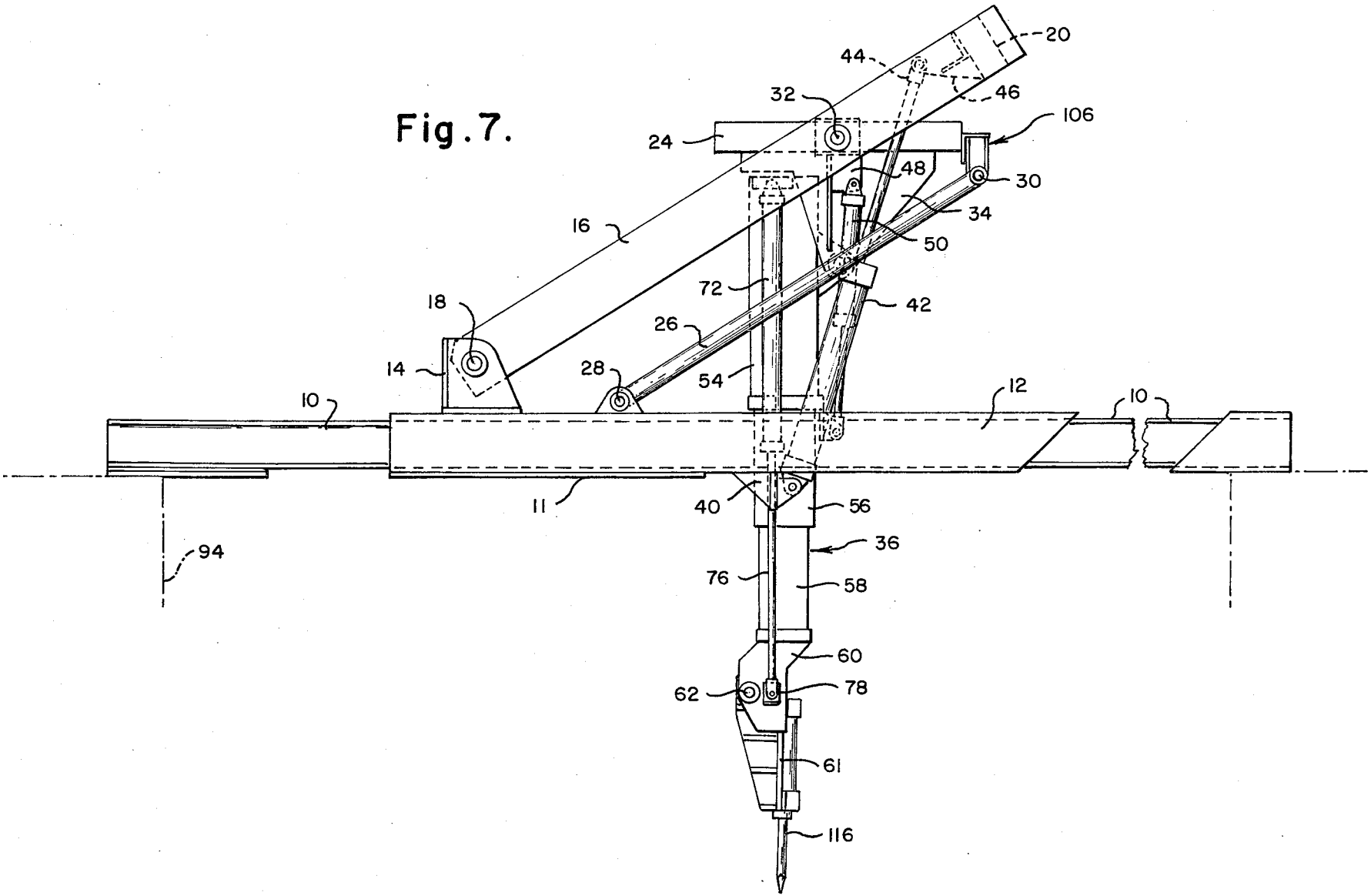
FIG. 7 is a side elevational view similar to FIG. 2 but shown in its elevated position.

Should the pit 94 be filled with slag 108 thus preventing the boom 36 and tool cradle 61 and tool 116 from tilting to an operable position, the turntable 24 which carries the boom 36 will be elevated by energizing cylinder 42 causing the first and second boom members 16 and 26 to pivot about their corresponding pivots 18, 32, 28 and 30 to raise the turntable 24 and boom assembly 36 from a collapsed position to a position shown in FIG. 7. It should be understood that FIG. 7 is the maximum elevation needed to allow a vertical positioning of the boom 36 in a shallow pit and that any intermediate station between that of FIG. 2 and FIG. 7 is possible by control of the hydraulic cylinder 42 extention. Also, because of the arrangement of the pivots 18, 32, 28 and 30, the turntable 24 will always remain in a level and horizontal position. This pivot arrangement becomes a parallelogram and remains so regardless of the elevation of the booms 16 and 26 by the cylinders 42.

Tilt of the boom 36 from a horizontal to a vertical position is accomplished by the cylinders 50 and the tilt of the tool cradle 61 is controlled by the cylinder 68 within the inner boom section 58.

Rotation of the boom 36 about the vertical axis of the turntable 24 is possible by hydraulic motors 90 driving pinions in mesh with an internal gear within said turntable. This drive means has been disclosed in prior patents of Louis A. Grant's soaking pit machines, U.S. Pat. Nos. 3,458,396 and 3,471,888.

The low profile design of the machine enables the cleaning operation of the pits to be continuous, even though the adjacent pits are being used. The soaking pit crane used to open and close the covers of the adjacent pits is now able to pass over the machine while it is in position over the pit being worked or cleaned. The machine is collapsed and the cover crane used to remove the adjacent pit covers passes freely over the soaking pit machine. Prior to this design, the entire bank of pits had to be shut down or the soaking pit machine had to be lifted from the work site to allow access to those pits that had to be opened for removal of ingots or charging the pit with ingots, which is considered to be "work in process" and no downtime is economically feasible from a production standpoint. Cleaning the soaking pits presented a costly inconvenience to the steel making process.

I claim:

1. A machine for breaking and removing slag from a soaking pit and presenting a low horizontal profile above the top of the pit to permit a soaking pit cover carriage to pass over the machine while resting on the soaking pit comprising:

a. a horizontal supporting frame for resting on top of the soaking pit;

b. a first means supporting a demolition tool downwardly from the horizontal frame for breaking the slag in the pit, wherein the first means comprises;

i. a turntable; and ii. a boom assembly pivotally mounted on a bottom surface of the turntable and extending downwardly from the turntable to which the demolition tool is pivotally mounted and, c. a second means coupling the first means to the horizontal supporting frame and raising the first means upwardly above the horizontal frame from a collapsed position, said collapsed position provides a low horizontal profile to permit the soaking pit cover carriage to pass over the soaking pit while the machine is resting on the soaking pit, the second means being capable of lowering the first means from the raised position back to the collapsed position, when the first means is raised above the frame the demolition tool is capable of breaking the slag in the pit, wherein the second means comprises:

i. a first boom member having one end pivotally connected to the horizontal supporting frame and having the turntable pivotally connected at another point along the boom; and ii. a second boom member having one end pivotally connected to the supporting frame and having the turntable pivotally connected at another point along the boom.

2. A machine as recited in claim 1 wherein the first and second boom members with four pivot point connections forms a parallelogram which at all times maintains the turntable parallel to the support frame.

3. A machine as recited in claim 1 including a means coupled between the support frame and the first boom for raising and lowering the first boom.

4. A machine as recited in claim 1 including a plurality of spaced apart first and second boom members.

* * * * *